US008030230B2

(12) United States Patent
Yoshida et al.

(10) Patent No.: US 8,030,230 B2
(45) Date of Patent: Oct. 4, 2011

(54) FLAME-RETARDANT LEATHER-LIKE SHEET AND PROCESS FOR PRODUCING THE SAME

(75) Inventors: Yasuhiro Yoshida, Okayama (JP); Masasi Meguro, Okayama (JP); Hisao Yoneda, Okayama (JP); Norio Makiyama, Okayama (JP); Tatsuya Nakashima, Okayama (JP); Yasumasa Tatekawa, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 435 days.

(21) Appl. No.: 12/377,504

(22) PCT Filed: Aug. 29, 2007

(86) PCT No.: PCT/JP2007/066798

§ 371 (c)(1),
(2), (4) Date: Feb. 13, 2009

(87) PCT Pub. No.: WO2008/026653

PCT Pub. Date: Mar. 6, 2008

(65) Prior Publication Data

US 2010/0247843 A1 Sep. 30, 2010

(30) Foreign Application Priority Data

Aug. 31, 2006 (JP) ..... 2006-234943

(51) Int. Cl.
*B32B 27/04* (2006.01)
*B32B 27/12* (2006.01)
*B32B 5/02* (2006.01)

(52) U.S. Cl. ..... 442/136; 442/66; 442/67; 442/141; 442/402; 442/408; 428/91; 428/904; 427/402; 8/495

(58) Field of Classification Search ..... 442/66, 442/67, 136, 141, 402, 408; 428/91, 904; 427/402; 8/495
See application file for complete search history.

(56) References Cited

U.S. PATENT DOCUMENTS

| | | | | |
|---|---|---|---|---|
| 6,599,849 | B1 | 7/2003 | Vogt et al. | |
| 7,091,139 | B2 * | 8/2006 | Nobuto et al. | 442/136 |
| 7,105,227 | B2 * | 9/2006 | Yasuda et al. | 428/365 |
| 2004/0029470 | A1 | 2/2004 | Vogt et al. | |
| 2007/0281147 | A1 * | 12/2007 | Feng et al. | 428/318.4 |
| 2009/0047476 | A1 | 2/2009 | Meguro et al. | |

FOREIGN PATENT DOCUMENTS

| | | | |
|---|---|---|---|
| EP | 1 371 774 | A2 | 12/2003 |
| EP | 1 371 774 | A3 | 12/2003 |
| JP | 61 246048 | | 11/1986 |
| JP | 3 80914 | | 4/1991 |
| JP | 5 302273 | | 11/1993 |
| JP | 7 18584 | | 1/1995 |
| JP | 2002 242082 | | 8/2002 |
| JP | 2004 502040 | | 1/2004 |
| JP | 2004 502041 | | 1/2004 |
| JP | 2004 169197 | | 6/2004 |
| JP | 2004 316035 | | 11/2004 |

OTHER PUBLICATIONS

U.S. Appl. No. 12/097,651, filed Jul. 23, 2008, Yoshida, et al.
U.S. Appl. No. 11/917,836, filed Jan. 7, 2009, Yoshida, et al.

* cited by examiner

*Primary Examiner* — Norca L Torres Velazquez
(74) *Attorney, Agent, or Firm* — Oblon, Spivak, McClelland, Maier & Neustadt, L.L.P.

(57) ABSTRACT

The present invention relates to a flame-retardant leather-like sheet having a soft hand, excellent surface touch and excellent appearance, which includes an entangled nonwoven fabric of microfine polyester fibers having an average single-fiber fineness of 0.5 dtex or less, and an elastic polymer contained inside the nonwoven fabric, wherein a flame-retardant is exhausted into the elastic polymer and wherein a flame retarder solution containing bubbles forcibly formed is applied to a back surface of the leather-like sheet so that the flame retarder is present in a region extending from the back surface to an inside of the leather-like sheet but is not present on side of a front surface of the leather-like sheet.

16 Claims, No Drawings

FLAME-RETARDANT LEATHER-LIKE SHEET AND PROCESS FOR PRODUCING THE SAME

TECHNICAL FIELD

The present invention relates to a flame-retardant leather-like sheet and to a method of manufacturing the same. More specifically, the present invention relates to a flame-retardant leather-like sheet having a soft hand, a good surface touch and a good appearance and to a method of efficiently manufacturing such a flame retardant leather-like sheet.

BACKGROUND ART

Leather-like sheets have been hitherto used in a variety of applications such as interiors, clothes, shoes, briefcases, gloves and upholstery materials for vehicle seats.

In particular, in the field of the upholstery materials for vehicle seats, such as railroad coach seats, automobile seats, airplane seats and ship seats, and for interiors such as cushion sheets, couches and chairs, there are strong demands for materials, especially suede-finished leather-like sheet materials which not only have a soft hand and a beautiful surface appearance but also exhibit various types of fastness, durability and wear resistance as well as excellent flame retardancy.

Hitherto, as a method for imparting flame retardancy to a leather-like sheet comprising a fibrous sheet as a base material, generally employed are a method in which a phosphorus compound is incorporated into the fibers which constitute the base material and a method in which fine particles of a flame retardant, such as a halogen compound containing chlorine or bromine as its main component or an antimony compound, are deposited with a binder on a back surface of the base material. In the case of a leather-like sheet using a nonwoven fabric of ultrafine fibers as a base material, the main trend has been toward the use of the latter method because the strength of ultrafine fibers is deteriorated when the former method is adopted.

In the case of the latter method, however, hazard of toxicity and generation of harmful substances during combustion has been pointed out. There is, therefore, a worldwide tendency to considerably limit the use of the latter method.

As regards a method for imparting flame retardancy to a suede-finished leather-like sheet, a method for back-coating with a flame retardant is disclosed for the development of an upholstery material for vehicle seats or airplane seats (for example, refer to Patent Documents 1 and 2).

With this method, however, the obtained leather-like sheet tends to give a hard hand and lack a high-quality appearance. Further, since the elongation is restricted, it tends to be difficult for the sheet to flexibly follow a complicated shape.

Disclosed also are a method for impregnating and applying a flame retardant in a finishing step of dyeing and a method of admixing a flame retardant to polyurethane (for example, refer to Patent Document 3).

With these method, however, it is necessary to deposit the flame retardant in a large amount in order to achieve flame retarding performance. Therefore, a surface stickiness and a reduction of hand occasionally occur.

Further, in the case of the latter method, the polyurethane resin tends to become poor in light fastness and, therefore, cannot be satisfactorily used as a sheet for an upholstery material of vehicle seats requiring particularly high light fastness.

In general, with a method in which an additive such as a flame retardant is incorporated into polyurethane, it is difficult to achieve both flame retarding performance and the properties inherent to the resin at the same time.

There is also disclosed technique in which elution of a flame retardant and deterioration of fiber physical properties during dyeing are overcome by copolymerizing a phosphorus-based flame retardant with thermoplastic synthetic fibers (for example, refer to Patent Document 4).

With this method, however, it is difficult to achieve both high flame retardancy and reduced cost at the same time because there is a restriction on the proportion of the fibers copolymerized with the phosphorus-based flame retardant due to cost problems.

As a method for imparting flame retardancy to a polyester-based fiber structure, it is also known to exhaust a flame retardant into the fiber in a bath for dyeing (for example, refer to Patent Document 5).

With this method, however, it is necessary to treat the polyester in a hot water at a temperature as high as 130° C. in order to dye the polyester. As a consequence, the flame retardant and a surfactant used for dispersing the flame retardant are apt to be decomposed and denaturated to cause fouling of inside portions of the dyeing apparatus and to reduce the productivity.

Patent Document 1: JP H03-80914B
Patent Document 2: JP H05-302273B
Patent Document 3: JP H07-18584A
Patent Document 4: JP 2004-169197A
Patent Document 5: JP 2004-1316035A

DISCLOSURE OF THE INVENTION

It is an object of the present invention to provide a leather-like sheet having a good appearance, a soft hand and excellent flame retardancy, and a method for producing such a flame retardant leather-like sheet.

As a result of extensive researches for obtaining a leather-like sheet having a soft hand and an excellent flame retardancy and suited for use as upholstery materials for vehicle seats and interiors such as cushion sheets, couches and chairs, the present inventors have reached the present invention.

Namely, the present invention provides the following aspects 1 to 16:

1. A flame retardant leather-like sheet comprising an entangled nonwoven fabric of polyester microfine fibers having an average single-fiber fineness of 0.5 dtex or less, and an elastic polymer A impregnated into the nonwoven fabric, wherein a flame retardant is exhausted into the elastic polymer A, and wherein the leather-like sheet further comprises a coating formed by applying a flame retarder liquid, which contains forcibly formed air bubbles, to a back surface of the leather-like sheet so that said flame retarder is present in a region extending from the back surface to an inside of the leather-like sheet but is not present on side of a front surface of the leather-like sheet;

2. The flame retardant leather-like sheet according to the above aspect 1, wherein the flame retardant exhausted into the elastic polymer A and the flame retarder applied to the back surface of the leather-like sheet are each a non-halogen flame retardant;

3. A flame retardant suede-finished leather-like sheet obtained by a method comprising the step of napping the front surface of the flame retardant leather-like sheet as defined in the above aspect 1;

4. A method of producing a flame retardant leather-like sheet, comprising successively subjecting a leather-like sheet, which comprises an entangled nonwoven fabric of polyester microfine fibers having an average single-fiber fineness of 0.5 dtex or less and an elastic polymer A impregnated into the nonwoven fabric, to the following steps (1) and (2):

(1) a step of immersing the leather-like sheet in a bath comprising a flame retardant dispersed or dissolved in hot water at a temperature of 50 to 100° C. to exhaust the flame retardant into the elastic polymer A; and (2) a step of applying a flame retarder liquid, which contains forcibly formed air bubbles, to a back surface of the leather-like sheet;

5. The method of producing a flame retardant leather-like sheet according to the above aspect 4, wherein the flame retarder liquid has a flame retarder content of 5 to 60% by mass;

6. The method of producing a flame retardant leather-like sheet according to the above aspect 4, wherein the flame retarder liquid containing forcibly formed air bubbles has an apparent density of 0.1 to 0.6 g/cm$^3$;

7. A flame retardant leather-like sheet comprising an entangled nonwoven fabric of polyester microfine fibers having an average single-fiber fineness of 0.5 dtex or less, and an elastic polymer A impregnated into the nonwoven fabric, said leather-like sheet being dyed with a disperse dye, wherein a hot water-soluble, phosphorus-based flame retardant is exhausted into at least an inside of the elastic polymer A, wherein a composition comprising a phosphorus-based flame retarder and an elastic polymer B is present in a region extending from a back surface to an inside of the leather-like sheet in the form of particles, aggregates or a mixture of particles and aggregates, in the form of porous bodies or in the form of a mixture of these forms, and wherein neither said phosphorus-based flame retarder nor said elastic polymer B is present on side of a front surface of the leather-like sheet;

8. The flame retardant leather-like sheet according to the above aspect 7, wherein the phosphorus-based flame retarder constituting said composition is at least one member selected from the group consisting of guanidine phosphate flame retarders, phosphoric carbamate flame retarders, phosphoric acid ester flame retarders, aromatic condensed phosphoric acid ester flame retarders, phosphoric acid ester amide flame retarders, ammonium polyphosphate flame retarders and flame retarders obtained by coating these flame retarders with a silicone resin;

9. The flame retardant leather-like sheet according to the above aspect 7, wherein the hot water-soluble, phosphorus-based flame retardant is at least one member selected from the group consisting of phosphoric acid ester flame retardants, aromatic condensed phosphoric acid ester flame retardants and phosphoric acid amide flame retardants;

10. The flame retardant leather-like sheet according to the above aspect 7, wherein said composition is present in the form of particles having a particle diameter of 1 to 20 μm, aggregates of said particles having a particle diameter of 10 to 500 μm or a mixture of said particles and said aggregates, in the form of porous bodies having a multiplicity of fine pores having a diameter of 1 to 100 μm or in the form of a mixture of these forms;

11. The flame retardant leather-like sheet according to the above aspect 7, wherein said composition forms a discontinuous flame retarder layer comprising domains having a diameter of 700 to 1,500 μm;

12. A method of producing a flame retardant leather-like sheet, comprising successively subjecting a leather-like sheet, which comprises an entangled nonwoven fabric of polyester microfine fibers having an average single-fiber fineness of 0.5 dtex or less and an elastic polymer A impregnated into the nonwoven fabric, to the following steps (a) to (c):

(a) a step of dyeing said leather-like sheet in a bath of disperse dye-containing hot water at a temperature of 100 to 150° C., and reducing and washing the dyed leather-like sheet;

(b) a step of treating the dyed leather-like sheet in a bath of a hot water containing a hot water-soluble, phosphorus-type flame retardant at a temperature of 50 to 100° C. to exhaust the flame retardant into the elastic polymer A; and (c) a step of forcibly applying to a back surface of the leather-like sheet, a foam processing liquid which has been obtained by foaming a solution comprising a phosphorus-based flame retarder, an elastic polymer B and a surfactant so that the obtained foam processing liquid contains bubbles having a diameter of 5 to 300 μm at least as a majority of whole bubbles therein;

13. The method of producing a flame retardant leather-like sheet according to the above aspect 12, wherein the elastic polymer A is an aqueous polyurethane;

14. The method of producing a flame retardant leather-like sheet according to the above aspect 12, wherein the elastic polymer B is an aqueous polyurethane;

15. The method of producing a flame retardant leather-like sheet according to the above aspect 12, wherein in the step (c), the foam processing liquid is applied by gravure coating or by screen coating; and 16. The method of producing a flame retardant leather-like sheet according to the above aspect 12, wherein the step (c) is followed by a step of mechanically flexing the obtained leather-like sheet.

The flame retardant leather-like sheet of the present invention has a soft hand and an excellent flame retardancy without sacrifice of its surface appearance.

According to the present invention, such a flame retardant leather-like sheet may be efficiently produced.

BEST MODE FOR CARRYING OUT THE INVENTION

As the fibers constituting the leather-like sheet of the present invention, polyester fibers may be used from the viewpoint of surface wear resistance, various kinds of fastness and resistance to deterioration.

The fibers must be microfine fibers having an average single-fiber fineness of 0.5 dtex or less in order to obtain a leather-like hand when formed into a leather-like sheet and to obtain a good touch and a fine writing effect when formed into a suede-finished leather-like sheet.

The average single-fiber fineness is preferably 0.3 dtex or less and more preferably not less than 0.0001 dtex and not more than 0.2 dtex.

The microfine fibers may be directly spun from a single polymer component or may be obtained from microfine fiber-forming fibers comprised of at least two kinds of polymers.

Examples of the microfine fiber-forming fibers include those of an extraction-type in which an island component is fibrillated into microfine fibers by dissolution or decomposition of a sea component and those of a division-type in which the polymers are fibrillated into microfine fibers of each polymer by a mechanical or chemical treatment.

The microfine fiber-forming fibers may be processed into short fibers having a fineness of 1 to 15 dtex, preferably 5 to 14 dtex and more preferably 8 to 13 dtex or long fibers having a fineness of 1 to 13 dtex, preferably 1 to 10 dtex and more preferably 1 to 8 dtex, if necessary, through treatment steps such as stretching, heat treating, mechanical crimping and cutting.

As the polymer for the microfine fibers, there may be used at least one polymer selected from the group consisting of melt-spinnable polyesters such as polyethylene terephthalate, polytrimethylene terephthalate, polybutylene terephthalate and copolymers and modified products thereof.

The component to be removed by extraction or decomposition upon the production of the extraction-type fibers is a polymer having a solubility to an extraction solvent or a decomposability by a decomposing agent which is different from that of the microfine fiber-forming component. Such a polymer must also be less compatible with the microfine fiber-forming component and, additionally, must have a smaller melt viscosity or a smaller surface tension than that of the microfine fiber-forming component under spinning conditions.

Examples of such a polymer include polyethylene, polystyrene and polyvinyl alcohol.

Among such polymers, polyvinyl alcohol which is soluble in hot water is preferably used in total consideration of environmental pollution, shrinkage during dissolution, etc.

If desired, the microfine fibers may be dyed with a pigment, typically carbon black, and compounded with a known additive for fibers as long as the effect of the present invention is not adversely affected.

The obtained short fibers or long fibers are formed into an entangled nonwoven fabric.

In the case of the short fibers, the fibers are carded and then formed into a web by being passed through a webber or by being slurried and collected. In the case of the long fibers, a web is formed simultaneously with the spinning, for example, by a spun-bonding method.

The obtained webs are superposed in a desired weight and thickness and, if necessary, pre-entangled by a known method such as needle punching and jet water.

The mass per unit area of the web is determined depending upon the desired mass per unit area of the end leather-like sheet and is generally in the range of 80 to 2,000 g/m$^2$, preferably in the range of 100 to 1,500 g/m$^2$ and more preferably in the range of 200 to 1,000 g/m$^2$.

When used as an upholstery material for vehicle seats, the entangled nonwoven fabric is preferably united with a woven/knitted fabric. The woven/knitted fabric is not specifically limited and may be suitably selected from those formed from fibers of known polymers.

To ensure a good entanglement of the nonwoven fabric with the woven/knitted fabric, the web before lamination with the woven/knitted fabric may be needle-punched to a needle punching density in the range of generally 20 to 100 punch/cm$^2$. The needle punching density is preferably in the range of 25 to 80 punch/cm$^2$ and more preferably 30 to 60 punch/cm$^2$.

The punching density as used herein is intended to mean a total accumulated number of felt needles punched through the web per unit area of the web during the needle punching. For example, when the web is punched 50 times by a needle board having felt needles in a density of 10/cm$^2$, the punching density during the needle punching is 500 punch/cm$^2$.

In the present invention, an elastic polymer A is impregnated in the inside (entangled space) of the obtained entangled nonwoven fabric of microfine fibers for the purpose of improving the leather-like hand, a dense feeling and the mechanical properties thereof.

As the elastic polymer A, any of known elastic polymers which are used for leather-like sheets may be used without particular limitations. Examples of the elastic polymer A include synthetic resins or natural polymer resins such as polyurethane resins, acrylic resins, polyvinyl chloride, polyamides, polyesters, neoprene, silicone resins and polyamino acids, and mixtures of these resins. Among them, polyurethane resins, acrylic resins, and mixtures and copolymers thereof are preferred.

From the standpoint of good hand and dense feeling, polyurethane is more preferred. If necessary, a pigment, a dye, a cross-linking agent, a filler, a plasticizer and various kinds of stabilizers may be incorporated into the polymer.

As a method for impregnating the polyurethane, there may be adopted a method in which the fabric is impregnated with a solution containing polyurethane dissolved in a good solvent therefor such as typically dimethylformamide, followed by wet coagulation and drying, or a method in which the fabric is impregnated with an aqueous emulsion of polyurethane without using a solvent, followed by heat-sensitive coagulation and drying. However, the method using the aqueous emulsion of polyurethane is preferred from the standpoint of process stability at a step of exhaustion of a flame retardant which is to be subsequently carried out for allowing the flame retardant dissolved in water as a medium to be absorbed in the elastic polymer A.

It is preferred that the elastic polymer A be impregnated into the entangled nonwoven fabric of microfine fibers such that the mass ratio of the entangled nonwoven fabric to the elastic polymer A is 50:50 to 98:2 and more preferably 50:50 to 90:10 from the viewpoints of obtaining both good hand and mechanical properties and allowing a required amount of the flame retardant to be exhausted into (namely to be incorporated into) the elastic polymer A in a stable manner.

When the entangled nonwoven fabric is formed from microfine fiber-forming fibers, the mass ratio of the elastic polymer A to the entangled nonwoven fabric is calculated based on the entangled fabric obtained after the conversion into microfine fibers.

When the fibers constituting the entangled nonwoven fabric are microfine fiber-forming fibers, a leather-like sheet is prepared by conversion thereof into microfine fibers which may be carried out before or after the impregnation of the elastic polymer A thereinto by any known methods.

In the production of a suede-finished leather-like sheet using the leather-like sheet obtained by the above method, the thickness of the leather-like sheet is regulated to a desired level by slicing or buffing. If necessary, the obtained sheet is applied with a solution or emulsion of an elastic polymer or a known treating agent such as a solvent to fix the fibers in a desired state. The surface is then buffed by a known method such as by using a sandpaper to nap or raise the fibers. The napped fibers are then dyed to obtain the desired suede-finished leather-like sheet.

In the production of grain-finished leather-like sheet having a grain surface, after regulating the thickness of the leather-like sheet by the same method as used above, the grain surface layer is formed by any known method to obtain the grain-finished leather-like sheet.

A method of imparting flame retardancy according to the present invention comprises successively subjecting the above-obtained leather-like sheet, which comprises the entangled nonwoven fabric of polyester microfine fibers having an average single-fiber fineness of 0.5 dtex or less, preferably 0.3 dtex or less, and more preferably not less than 0.0001 dtex and not more than 0.2 dtex, and the elastic polymer A impregnated into the nonwoven fabric, to the following steps (1) and (2):

(1) a step of immersing the leather-like sheet in a bath comprising a flame retardant dispersed or dissolved in hot water at a temperature of 50 to 100° C. to exhaust the flame retardant into the elastic polymer A; and (2) a step of applying a flame retarder liquid, which contains forcibly formed air bubbles, to a back surface of the leather-like sheet.

In the present invention, the above step (1) is carried out after the dyeing step.

Another method of imparting flame retardancy according to the present invention comprises successively subjecting a leather-like sheet, which comprises an entangled nonwoven fabric of polyester microfine fibers having an average single-fiber fineness of 0.5 dtex or less, preferably 0.3 dtex or less, and more preferably not less than 0.0001 dtex and not more than 0.2 dtex, and an elastic polymer A impregnated into the nonwoven fabric, to the following steps (a) to (c):

(a) a step of dyeing the leather-like sheet in a bath of disperse dye-containing hot water at a temperature of 100 to 150° C., and reducing and washing the dyed leather-like sheet;

(b) a step of treating the dyed leather-like sheet in a bath of a hot water containing a hot water-soluble, phosphorus-type flame retardant at a temperature of 50 to 100° C. to exhaust the flame retardant into the elastic polymer A; and (c) a step of forcibly applying to a back surface of the leather-like sheet, a foam processing liquid which has been obtained by foaming a solution comprising a phosphorus-based flame retarder, an elastic polymer B and a surfactant so that the obtained foam processing liquid contains bubbles having a diameter of 5 to 300 μm at least as a majority of whole bubbles therein.

In the above step (1) or (b), the flame retardant may be selectively exhausted into the elastic polymer A of the leather-like sheet, namely selectively incorporated into the elastic polymer A.

The exhaustion treatment time is preferably 10 to 60 min, more preferably 20 to 60 min and still more preferably 20 to 40 min, from the viewpoint of exhaustion efficiency.

The reason why the exhaustion treatment is carried out after the dyeing step in the present invention is as follows. In a generally employed method, a flame retardant is exhausted simultaneously with a dyeing step for polyester fibers, which step is generally performed at a temperature higher than 100° C., particularly 125 to 140° C. At such a high temperature, the flame retardant which remains unexhausted in the leather-like sheet, or additives such as especially a surfactant, which are emulsified or dispersed in the flame retardant, are apt to be converted into tar-like substances to cause considerable fouling of the dyeing vessel.

Further, when the flame retardant is exhausted into the microfine fibers simultaneously with the dyeing in the same bath, the microfine fibers tend to suffer from more significant deterioration in strength and fastness than that of ordinary regular polyester fibers.

When the exhaustion temperature is 50° C. or more, the flame retardant or the additive-containing flame retardant, especially emulsifier-containing flame retardant, is finely dispersed or dissolved in water to ensure effective exhaustion of the flame retardant.

Further, when the exhaustion temperature is 50° C. or more, the flame retardant may be sufficiently and selectively exhausted into the elastic polymer A.

An elastic polymer having a glass transition point ranging from −60° C. to 0° C. is generally used as the elastic polymer A constituting the leather-like sheet from the standpoint of good hand of the leather-like sheet. In this case, when the exhaustion temperature is 50° C. or more and, therefore, higher by not less than 50° C. than the glass transition temperature of the elastic polymer A, the flame retardant can be sufficiently exhausted into the elastic polymer A.

From the viewpoint of enhancing the exhaustion of the flame retardant into the elastic polymer A, the exhaustion temperature is preferably 60° C. or more.

As described above, it is necessary that the exhaustion temperature should be 100° C. or less in order to prevent the fouling of the dyeing vessel by the flame retardant. There is an occasion where exhaustion temperature is desired to be lower than the glass transition point of the component constituting the microfine fibers.

The reason for this is that as the exhaustion temperature increases beyond the glass transition temperature of the polymer constituting the microfine fibers, the flame retardant is exhausted more easily into the microfine fibers than into the elastic polymer. Namely, it is difficult to selectively exhaust the flame retardant into the elastic polymer A.

Further, when the temperature of the bath used for the exhaustion treatment, which is carried out after the dyeing in the present invention, is higher than the glass transition temperature of the microfine fibers, the dye contained in the fibers is released back into the bath, so that change of color and deterioration in dye fastness tend to occur.

Therefore, when the exhaustion temperature is not higher than the glass transition temperature of the component constituting the microfine fibers, it is possible to selectively exhaust the flame retardant into the elastic polymer A and to effectively achieve the effect of the present invention.

Thus, the exhaustion temperature is preferably lower, by 30° C. or less, more preferably by 20° C. or less, and still more preferably by 10° C. or less, than the glass transition temperature of the microfine fibers.

When the microfine fibers are made of generally employed polyethylene terephthalate, which has a glass transition temperature of 81° C., the exhaustion treatment temperature is preferably 80° C. or less.

The exhaustion treatment temperature may be thus selected from the range of 50 to 100° C. in consideration of the glass transition temperature of the elastic polymer A and the glass transition temperature of the component constituting the microfine fibers.

It is necessary that the flame retardant which is subjected to the exhaustion treatment should be formed into a flame retardant liquid in the form of an aqueous dispersion or an aqueous solution. Further, the flame retardant preferably has a low affinity with water, i.e., is hardly soluble or insoluble in water, and is kept in a solid state as measured at 25° C., in order to prevent the flame retardant leather-like sheet from being deteriorated in its fastness due to the flame retardant. It is more preferred that the flame retardant be a hot water-soluble flame retardant which is not water-soluble at 25° C. but is water-soluble at the above-described exhaustion treatment temperature.

The concentration of the flame retardant to be exhausted is generally 1 to 30% owf based on the mass of the leather-like sheet.

The flame retardant concentration is preferably 2 to 25% owf and more preferably 3 to 20% owf.

Meanwhile, the unit "% owf" as used herein is intended to mean a percentage concentration of the flame retardant, etc., based on the weight of the leather-like sheet.

When the flame retardant concentration is 1% owf or more, the amount of a flame retarder applied to the back surface of the leather-like sheet in the succeeding step (2) or step (c) can be reduced so that the hand becomes soft and hand of the leather-like sheet is not deteriorated.

When the flame retardant concentration is 30% owf or less, the amount of unnecessary flame retardant which has not been exhausted can be reduced so that the cost may be reduced. Further, the amount of the flame retardant which has not been exhausted and which remains in the dyeing bath may be reduced so that fouling of the exhaustion treatment vessel may be prevented.

Incidentally, after the exhaustion treatment, drying may be carried out without any restriction by using any known drying method.

The flame retardant exhaustion treatment in the present invention may be carried out in any proper manner according to the object of use or necessity of other steps, as long as the exhaustion treatment is performed after the dyeing step. However, the exhaustion treatment is preferably carried out in the dyeing vessel after completion of dyeing, reduction and neutralization in order to prevent falling off of exhausted flame retardant and to simplify the treatment as much as possible.

The above-described step (2) or step (c) comprises forming a foam processing liquid which is a flame retarder liquid containing forcibly formed air bubbles, applying the foam processing liquid to a back surface of the leather-like sheet, and drying the applied foam processing liquid, so that the flame retarder is present in a region extending from the back surface to an inside of the leather-like sheet but is not present on side of a front surface of the leather-like sheet. The flame retarder is preferably present in the form of particles, aggregates or a mixture of particles and aggregates, in the form of porous bodies or in the form of a mixture of these forms.

The flame retarder liquid to be applied on a back surface of the leather-like sheet is preferably in the form of an aqueous liquid or an aqueous solution from the viewpoint of a good stability of air bubbles contained therein. In order to allow the flame retarder liquid to be present in the above-described preferred form, it is preferred that the flame retarder liquid be an aqueous dispersion comprising a flame retarder, an elastic polymer B, and a surfactant.

As the elastic polymer B, elastic polymers exemplified above in connection with the elastic polymer A may be used. However, from the standpoint of hand, mechanical properties and durability of the leather-like sheet, polyurethane is preferably used. Further, an aqueous polyurethane is preferred since the elastic polymer A already contained is not dissolved therein so that it is easy for the elastic polymer B to be present discontinuously.

There is no specific restriction on the kind of polyurethane. Known polyester-based, polyether-based or polycarbonate-based polyurethanes, mixtures thereof and copolymers thereof may be used.

The concentration of the flame retarder in the flame retarder liquid is generally 5 to 60% by mass based on the total amount of the flamer retarder and the elastic polymer B in consideration of generation of bubbles and attainment of both desired flame retardancy and hand of the leather-like sheet.

When the flame retarder concentration is 5% or more, it is easy to coat the flame retarder in an amount capable of exhibiting a sufficient flame retardancy. Further, the efficiency of drying for removing the solvent is improved and, additionally, the effect for imparting flame retardancy to the leather-like sheet may be sufficiently obtained.

When the flame retarder concentration is 60% or less, the applied flame retarder can be sufficiently impregnated into the leather-like sheet without locally accumulate on or near the back surface of the leather-like sheet, so that the hand of the leather-like sheet is not deteriorated.

The concentration of the flame retarder is preferably 10 to 60% by mass and more preferably 20 to 50% by mass.

In the present invention, when the flame retarder liquid is applied to a back surface of the leather-like sheet, there is adopted the coating method in which the flame retarder liquid in the form of a foam (containing bubbles) is allowed to penetrate into the sheet, in particular, the suede-finished leather-like sheet containing the elastic polymer A into which a flame retardant is exhausted, from the back surface thereof. By virtue of such a specific coating method, the flame retarder is prevented from reaching the front surface of the suede-finished leather-like sheet. Therefore, the flame retarder composition is present in a region extending from the back surface to an inside of the leather-like sheet in the form of particles, aggregates or a mixture of particles and aggregates, in the form of porous bodies or in the form of a mixture of these forms. As a consequence, not only an excellent surface touch and hand but also a good flame retardancy may be obtained at the same time.

As the flame retardant and flame retarder used in the present invention, a non-halogen flame retardant, preferably a phosphorus-based flame retardant, may be used for reasons of reduction of environmental hormone pollution caused by halogen-containing flame retardants.

As the flame retardant for use in the exhaustion treatment, there may be used phosphoric acid ester flame retardants, aromatic condensed phosphoric acid ester flame retardants and phosphoric acid amide flame retardants. From the viewpoint of prevention of deterioration of the leather-like sheet by hydrolysis of the flame retardant, aromatic condensed phosphoric acid ester flame retardants and phosphoric acid amide flame retardants are preferred.

As the flame retarder to be applied to the back surface of the leather-like sheet, there may be used guanidine phosphate flame retarders, phosphoric carbamate flame retarders, phosphoric acid ester flame retarders, aromatic condensed phosphoric acid ester flame retarders, phosphoric acid ester amide flame retarders, ammonium polyphosphate flame retarders and flame retarders obtained by coating these flame retarders with a silicone resin.

It is more preferred that the flame retardant and retarder be insoluble in water at least at 25° C. because deterioration of the leather-like sheet by hydrolysis of the flame retardant or retarder can be avoided and because a water-soluble flame retardant or retarder would causes stains when water droplets deposit on the treated cloth. For the same reasons, aromatic condensed phosphoric acid flame retarders or retardants, phosphoric acid ester amide flame retarders or retardants, and ammonium polyphosphate flame retarders or retardants coated with a silicone resin are still more preferred.

The content of the flame retardant or retarder in the leather-like sheet for imparting flame retardancy to the leather-like sheet may vary depending upon the phosphorus content thereof, and thus may vary with the kind thereof. However, the amount of the flame retardant exhausted is 1 to 40 g/m$^2$ and the amount of the flame retarder coated on a back surface of the leather-like sheet is 5 to 60 g/m$^2$ with the total amount of both being in the range of 6 to 80 g/m$^2$, in terms of the solid content of the flame retardant or/and retarder, from the viewpoint of achievement of both good flame retardancy and hand.

The amount of the flame retardant exhausted is preferably 5 to 35 g/m$^2$ and the amount of the flame retarder coated on a back surface of the leather-like sheet is preferably 10 to 60 g/m$^2$ with the total amount of both being preferably in the range of 15 to 75 g/m$^2$. More preferably, the amount of the flame retardant exhausted is 10 to 30 g/m$^2$ and the amount of the flame retarder coated on a back surface of the leather-like sheet is 10 to 50 g/m$^2$ with the total amount of both being in the range of 20 to 70 g/m$^2$.

It is also preferred that, as long as the desired flame retardancy and the required effect of the present invention, such as the hand and properties of the leather-like sheet, are not adversely affected, the flame retarder liquid to be applied to a back surface of the leather-like sheet be a composition containing an elastic polymer B as a binder for the flame retarder in order to prevent falling off of the flame retarder from the leather-like sheet after the coating treatment.

The elastic polymer B, when used as the binder, is preferably an aqueous polyurethane and more preferably in the form of an emulsion thereof.

The application of the flame retarder liquid to a back surface of the leather-like sheet may be preferably performed in such a manner that the flame retarder liquid contains forcibly formed air bubbles, for example, in such a manner that the stirred flame retarder liquid usually has an apparent density of 0.1 to 0.6 g/cm$^3$, so that the flame retarder that penetrates from the back surface into an inside of the leather-like sheet is prevented from reaching the front surface thereof. The applied flame retarder liquid is then dried for the removal of the solvent therefrom.

The flame retarder liquid preferably has an apparent density of 0.15 to 0.5 g/cm$^3$ and more preferably 0.2 to 0.5 g/cm$^3$.

When the apparent density of the flame retarder liquid is 0.1 g/cm$^3$ or more, the content of the flame retarder per unit volume of the leather-like sheet is ensured so that the flame retarder can be applied in an amount sufficient to obtain desired flame retarding performance.

When the apparent density of the flame retarder liquid is 0.6 g/cm$^3$ or less, the flame retarder liquid can suitably retain the bubbles contained therein.

As a method for foaming the flame retarder liquid, there may be used, for example, a mechanical foaming method. In this case, it is preferable to add, as a foaming agent, a known surfactant such as typically a cationic surfactant in an amount of generally 1 to 5% by mass.

The amount of the surfactant added is preferably 1.5 to 5% by mass and more preferably 1.5 to 4% by mass.

By addition of such a surfactant, bubbles having a uniform size can be stably contained in the flame retarder liquid. In order for the flame retarder to be present in the above-described preferred form, namely in the form of particles, aggregates or a mixture of particles and aggregates, in the form of porous bodies or in the form of a mixture of these forms, it is necessary that the flame retarder liquid should form a foam processing liquid containing bubbles having a diameter of 5 to 300 μm at least as a majority of whole bubbles therein, because of a balance between the size of the bubbles and the fiber diameter of the microfine fibers constituting the leather-like sheet. The foam processing liquid preferably contains bubbles having a diameter of 7 to 250 μm and more preferably 10 to 150 μm as a majority of whole bubbles contained therein. The most preferred foam processing contains bubbles having a diameter of 12 to 100 μm as a majority of whole bubbles contained therein.

As long as a majority of bubbles contained in the foam processing liquid have a diameter within the above-described suitable range and a uniform size and as long as the effect of the present invention is not adversely affected, bubbles having a greater diameter than that of the majority ones may be contained therein.

The term "foam processing liquid containing bubbles having a diameter of 5 to 300 μm an as a majority of whole bubbles therein" is intended to mean a foam processing liquid in which, when observed by the below-mentioned method, at least 50%, preferably at least 70% and still more preferably at least 90% of bubbles being present in an observed viewing area have a diameter in the range of 5 to 300 μm.

Upon the application of the flame retarder liquid to a back surface of the leather-like sheet, the content (coating amount) of the flame retarder may be preferably controlled by a method in which the amount of a bubble-containing aqueous dispersion or solution of the flame retarder which is discharged onto the leather-like sheet, is adjusted using a knife; a so-called screen method in which a bubble-containing flame retarder liquid to be applied is discharged from an inside of a mesh roll disposed above the back surface of the leather-like sheet toward outside thereof while controlling the amount of the applied liquid by adjusting a mesh size of the mesh roll, a clearance between the mesh roll and the leather-like sheet or an applied pressure of the roll; or a so-called gravure method in which the flame retarder liquid is applied by transferring the liquid in an amount measured by cups or slits engraved on a surface of a gravure roll.

After completion of the application of the flame retarder liquid, the leather-like sheet is preferably dried while controlling the width thereof using, for example, a tenter dryer.

By adopting the above-described application method and drying method, the flame retarder or a mixture of the flame retarder and the elastic polymer B applied to a back surface of the leather-like sheet can be present in a specific form as defined in the present invention.

The specific form of the flame retarder or a mixture of the flame retarder and the elastic polymer B is in the form of particles having a particle diameter of 1 to 20 μm, aggregates of the particles having a particle diameter of 10 to 500 μm or a mixture of the particles and the aggregates, in the form of porous bodies having a multiplicity of fine pores having a diameter of 1 to 100 μm or in the form of a mixture of these forms.

These forms may vary depending upon the properties of the flame retarder liquid applied such as apparent density, viscosity and diameter of bubbles, the local variation in content of the flame retarder liquid, the local variation of the surface condition of the leather-like sheet onto which the flame retarder liquid is coated, and the drying method and condition after the coating. Thus, the form of the flame retarder or a mixture of the flame retarder and the elastic polymer B may be controlled by properly setting the conditions according to the desired flame retardancy and hand feeling.

More specifically, in the areas where the amount of the flame retarder liquid is locally small, there is such a tendency that the flame retarder or a mixture of the flame retarder and the elastic polymer B is present in the form of particles or aggregates of the particles. When the amount of the flame retarder becomes larger, the flame retarder or a mixture of the flame retarder and the elastic polymer B tends to be present in a porous form.

When the flame retarder or a mixture of the flame retarder and the elastic polymer B is present in the specific form of the present invention, the coated flame retarder can exhibit sufficient flame retardancy without adversely affecting the hand of the leather-like sheet.

From the viewpoint of hand of the leather-like sheet, it is preferred that the flame retarder or a mixture of the flame retarder and the elastic polymer B form a discontinuous flame retarder layer which comprises domains having a diameter of 700 to 1,500 μm.

Such a flame retarder layer may be formed by adequately controlling the conditions of the gravure method or screen method adopted as a coating method in the above-described step (2) or the above-described step (c) or by conducting mechanical flexing treatment as a post step of the above-described step (2) or the above-described step (c).

EXAMPLES

The present invention will be described in more detail by reference to the following examples. It should be noted, however, that the scope of the invention is not limited to the examples.

The average single-fiber fineness of microfine fibers was measured as follows:

$$\text{Average single-fiber fineness (dtex)}=D\times(R/2)^2\times\pi\times10^6$$

wherein R represents an average diameter (cm) of the microfine fibers in bundles of the microfine fibers and D represents a specific gravity of the polymer constituting the microfine fibers. (The average diameter is determined as follows: In a cross-section of a substrate obtained by a scanning electron micrograph, 10 bundles of microfine fibers are selected at random. From each of the cross-sections of the selected bundles, 20 microfine fibers are evenly selected at random and measured for their diameters. The arithmetic mean of the measured diameters is the average diameter of the microfine fibers).

The flammability was evaluated according to the measuring method described in Testing Method for Seat-Trim Fabrics (JASO M 403-88) by Society of Automotive Engineers of Japan, Inc.

The apparent density of the flame retarder liquid was measured as follows. A quantity of the foamed flame retarder liquid was placed in a 500 mL measuring cylinder to measure the volume thereof and the weight thereof, from which the apparent density was calculated.

The diameters of bubbles contained in the flame retarder liquid were measured using an optical microscope capable of continuously changing the magnification from a low magnification (about 30 to 150 times) to a high magnification (about 800 to 3,000 times). The flame retarder liquid was observed at various magnifications in the range of 100 to 1,000 times to determine the diameters.

The observation of the flame retarder liquid was quickly conducted before the change in state of the liquid occurred by drying.

Example 1

Preparation of Entangled Nonwoven Fabric

A polyvinyl alcohol (PVA) copolymer (EXEVAL manufactured by Kuraray Co., Ltd.; as sea component) containing 10 mol % of ethylene units and having a saponification degree of 98.4 mol % and a melting point of 210° C., and chips of polyethylene terephthalate (melting point: 234° C., glass transition temperature: 81° C.) as island component having an intrinsic viscosity of 0.65 dL/g (measured at 30° C. using a phenol/tetrachloroethane equal mass mixed solvent) and containing 8 mol % of isophthalic acid units, were extruded and spun from a spinneret (0.25ϕ, 550 holes) for melt composite spinning (number of islands: 37/fiber) at 250° C. in a sea component/island component ratio (by mass) of 30/70.

The spun fibers were stretched under ordinary conditions by a roller plate method to obtain sea-island composite fibers.

The spinnability, continuous running efficiency and stretchability of the obtained fibers were good and had no problem.

The sea-island composite fibers were crimped with a crimper and cut into 51 mm to obtain staples.

The sea-island composite fiber staples had a single-fiber fineness of 4.13 dtex, a strength of 3.2 cN/dtex and an elongation of 40% and were good.

The above staples ware made into a web by carding and cross lapping. The web was entangled by needle punching in a density of 40 punch/cm$^2$, to obtain an entangled nonwoven fabric comprising microfine fiber-forming fibers, which had a mass per unit area of 265 g/m$^2$.

Preparation of Plain-Woven Fabric

Polyester yarns (84 dtex/36 f) which had been subjected to false twisting were further subjected to additional twisting by 600 T/m and then woven at a fabric density of 82×76/inch (2.54 cm) to obtain a plain-woven fabric having a mass per unit area of 55 g/m$^2$.

Preparation of Three Dimensional Fiber Entangled Body Composed of Entangled Nonwoven Fabric and Woven Fabric The above-obtained entangled nonwoven fabric and the plain-woven fabric were superposed on each other. The superposed body was needle-punched using single barb felt needles first from the side of the entangled nonwoven fabric in a punching density of 1200 punch/cm$^2$ and then from the side of the plain-woven fabric in a punching density of 400 punch/cm$^2$ for integration into a unitary body and to obtain a three dimensional fiber entangled body having a mass per unit area of 385 g/m$^2$.

In the needle punching, a penetration depth of the felt needles penetrated from the entangled nonwoven fabric side was adjusted such that the barbs were able to penetrate through the plain-woven fabric, while a penetration depth of the felt needles penetrated from the nonwoven fabric side was adjusted such that the barbs did not penetrate through the entangled nonwoven fabric.

Preparation of Suede-Finished Leather-Like Sheet

The obtained three dimensional fiber entangled body was subjected to a dry heat shrinkage treatment at 205° C. with a hot air flow rate of 42.5 cm$^3$/min·m$^2$ at a treatment speed of 3 m/min and pressed with a metal press roll at 175° C. to adjust the apparent density of the three dimensional fiber entangled body to 0.340 g/cm$^3$ (thickness: 1.54 mm). The resulting three dimensional fiber entangled body was then impregnated with a 10% by mass aqueous polyurethane emulsion liquid (APC-28 manufactured by Nicca Chemical Co., Ltd.; glass transition temperature: −25° C.) as a polyurethane impregnation liquid and squeezed with a mangle to a pickup of 100%.

Thereafter, the three dimensional fiber entangled body was continuously heated and dried at 150° C. for 5 minutes and 30 seconds by a pin tenter dryer so that the elastic polymer A was impregnated therein.

The resulting three dimensional fiber entangled body was subjected to repeated immersion into hot water at 90° C. and squeezing treatments to remove PVA of the sea component, followed by drying. Then, the obtained body was further heated and dried by a pin tenter dryer at 120° C.

Thereafter, the surface of the entangled nonwoven fabric side of the three dimensional fiber entangled body was subjected to a napping treatment by being buffed by a sand paper to obtain a suede-finished leather-like sheet having a thickness of 0.85 mm and a mass per unit area of 395 g/m$^2$.

Dyeing and Flame Retardancy-Imparting Treatments of Suede-Finished Leather-Like Sheet The obtained suede-finished leather-like sheet was dyed to light green by jet dyeing at 130° C. for 1 hour using a dispersion dye, and then subjected to reducing and neutralization treatments.

The dyed suede-finished leather-like sheet was immersed in a flame retardant liquid containing 10% owf (solid content: 4%) (based on the mass of the sheet before dyeing) of VIGOL FV-1010 (manufactured by Daikyo Chemical Co., Ltd.; solid content: 40% by mass; phosphoric acid ester amide flame retardant; hot water-soluble flame retardant which is solid at 25° C. and soluble in hot water at 80° C.) and subjected to exhaustion treatment at 90° C. for 30 min. Thereafter, the sheet was dried at 120° C.

From the change in weight of the sheet before and after the exhaustion, it was confirmed that the exhaustion amount of the flame retardant was 11 g/m$^2$.

Separately, NEOSTECKER HF-680C (manufactured by Nicca Chemical Co., Ltd.; solid content: 40% by mass; capsulated ammonium polyphosphate flame retarder; containing an aqueous polyurethane binder) was mixed with 3% by mass of a foaming agent composed of a cationic surfactant (MEI-FOAMER F-210 manufactured by Meisei Chemical Works, Ltd.). The mixture was mechanically foamed to have an apparent density of 0.3 g/cm$^3$ to obtain a foam processing liquid composed of an aqueous flame retarder solution containing air bubbles having such a uniform size that 90 to 95% of the whole bubbles had a diameter in the range of 17 to 75 μm.

The foam processing liquid was discharged from the inside of a mesh roll having an open area ratio of 40% and a diameter of openings of 1,140 μm and applied to a back surface of the exhaustion-treated suede-finished leather-like sheet by a screen method. The applied amount of the foam processing liquid was 50 g/m$^2$.

The mesh roll was spaced by a distance of 0.4 mm from the sheet.

The resulting sheet was continuously heated and dried at 140° C. for 3 min by a pin tenter dryer. It was confirmed that the solid content of the flame retarder coated on the back surface of the sheet was 20 g/m$^2$.

Raised fiber portions on the front surface of the thus obtained flame retardant suede-finished leather-like sheet were free from tacky or slimy touch attributed to the flame retarder. The leather-like sheet, though it was imparted with flame retardancy, had excellent hand, touch and writing effect for use as upholstery materials for vehicle seats and interiors.

Cross-sections of the flame retardant suede-finished leather-like sheet were observed with a scanning electric microscope to evaluate the coating condition of the flame retarder. As a result, it was confirmed that no flame retarder was present in the vicinity of the napped surface, and the flame retarder was present in a region extending in the thickness direction from the back surface up to the center.

The back surface of the flame retardant suede-finished leather-like sheet was also observed with a scanning electric microscope. As a result, it was confirmed that a discontinuous flame retarder layer composed of many domains comprising the flame retarder and having a diameter of about 1,000 to 1,200 μm was formed on the whole area of the back surface, and that, in the areas between the domains where the amount of the flame retarder was small, the flame retarder was mainly present in the form of particles having various sizes in the range of about 2 to 10 μm, in the form of aggregates of the particles having various sizes in the range of about 25 to 300 μm, and in the form of mixtures of such particles and aggregates.

Further, as a result of observing the domain surfaces, it was confirmed that they were porous bodies having many fine pores having a diameter of about 10 to 70 μm. It was also confirmed that in the areas between the domains, there were many porous bodies of the flame retarder with a diameter of about 150 to 300 μm which were considered to be fragments of the domains.

The flame retardant suede-finished leather-like sheet was subjected to a flammability test. As a result, it was confirmed that the sheet was self-extinguishing and had sufficient flame retardant performance for use as upholstery materials for vehicle seats and interiors.

Example 2

The procedures of Example 1 up to and including the application of the flame retarder were performed in the same manner except for forming a three dimensional fiber entangled body using only the entangled nonwoven fabric (without superposing the plain-woven fabric thereon) and for changing the density after dry heat shrinkage to 0.45 g/m$^3$. Following the application of the flame retarder, a mechanical flexing treatment was performed using an air tumbler to obtain a flame retardant suede-finished leather-like sheet.

Raised fiber portions on the front surface of the thus obtained flame retardant suede-finished leather-like sheet were free from tacky or slimy touch attributed to the flame retarder. The leather-like sheet, though it was imparted with flame retardancy, had excellent hand, touch and writing effect for use as shoes, briefcases and interiors.

Also, when cross-sections of the flame retardant suede-finished leather-like sheet were observed with a scanning electric microscope to evaluate the coating condition of the flame retarder, it was confirmed that no flame retarder was present in the vicinity of the napped surface, and the flame retarder was present in a region extending in the thickness direction from the back surface up to the center.

Further, when the back surface of the flame retardant suede-finished leather-like sheet was also observed with a scanning electric microscope, it was confirmed that a discontinuous flame retarder layer composed of many domains comprising the flame retarder and having a diameter of about 800 to 1,100 μm was formed on the whole area of the back surface, and that, in the areas between the domains where the amount of the flame retarder was small, the flame retarder was mainly present in the form of particles having various sizes in the range of about 2 to 10 μm, in the form of aggregates of the particles having various sizes in the range of about 25 to 300 μm, and in the form of mixtures of such particles and aggregates.

In addition, as a result of observing the domain surfaces, it was confirmed that they were porous bodies having many fine pores having a diameter of about 10 to 70 μm. It was also confirmed that in the areas between the domains, porous bodies of the flame retarder with a diameter of about 70 to 300 μm which were considered to be fragments of the domains, were present in a large amount as compared with Example 1.

The flame retardant suede-finished leather-like sheet was subjected to a flammability test. As a result, it was confirmed that the sheet was self-extinguishing and had sufficient flame retardant performance for use as shoes, briefcases and interiors.

Comparative Example 1

A suede-finished leather-like sheet was prepared in the same manner as in Example 1 except for not carrying out the treatment of exhaustion of the flame retardant into the elastic polymer A.

Raised fiber portions on the front surface of the thus obtained suede-finished leather-like sheet were free from tacky or slimy touch attributed to the flame retarder. The leather-like sheet had sufficiently excellent hand for use as upholstery materials for vehicle seats and interiors.

Also, when cross-sections of the suede-finished leather-like sheet were observed with a scanning electric microscope to evaluate the coating condition of the flame retarder, it was confirmed that no flame retarder was present in the vicinity of the napped surface, and the flame retarder was present in a region extending in the thickness direction from the back surface up to the center.

Further, when the back surface of the suede-finished leather-like sheet was also observed with a scanning electric microscope, it was confirmed that a flame retarder layer similar to that in Example 1 was present over the whole back surface.

However, when the suede-finished leather-like sheet was subjected to a flammability test, it was confirmed that the sheet was extremely flammable. Thus, the flame retardant performance of the sheet was insufficient for use as upholstery materials for vehicle seats and interiors.

Comparative Example 2

A suede-finished leather-like sheet was prepared in the same manner as in Example 1 except for not carrying out the treatment of exhaustion of the flame retardant into the elastic polymer A and for changing the amount of the foam processing liquid applied to a back surface of the leather-like sheet to 150 g/m$^2$.

Raised fiber portions on the front surface of the thus obtained suede-finished leather-like sheet were free from tacky or slimy touch attributed to the flame retarder. When the suede-finished leather-like sheet was subjected to a flammability test, it was confirmed that the sheet was self-extinguishing. The sheet, however, had a buckling feeling, was easily bent and provided a hard hand as compared with the flame retardant suede-finished leather-like sheet of Example 1 and, therefore, had a hand level which was ill-suited for use as upholstery materials for vehicle seats and interiors.

Comparative Example 3

A suede-finished leather-like sheet was prepared in the same manner as in Example 1 except for not carrying out the application of the flame retarder to the back surface of the leather-like sheet.

Raised fiber portions on the front surface of the thus obtained suede-finished leather-like sheet were free from tacky or slimy touch attributed to the flame retarder. The suede-finished leather-like sheet had an excellent hand for use as upholstery materials for vehicle seats and interiors.

However, when the suede-finished leather-like sheet was subjected to a flammability test, it was confirmed that the sheet was extremely flammable. Thus, the flame retardant performance of the sheet was insufficient for use as upholstery materials for vehicle seats and interiors.

Comparative Example 4

A suede-finished leather-like sheet was prepared in the same manner as in Example 1 except for changing the amount of the flame retardant exhausted into the elastic polymer A to 40% owf (solid content: 16%) and for not carrying out the application of the foam processing liquid to the back surface of the leather-like sheet.

Raised fiber portions on the front surface of the thus obtained suede-finished leather-like sheet had a coarse touch, a somewhat hard hand as compared with the flame retardant suede-finished leather-like sheet of Example 1, probably due to the presence of excess flame retardant deposits which had not been exhausted into the elastic polymer A. Thus, the leather-like sheet was apparently at a low level for use as upholstery materials for vehicle seats and interiors.

When the suede-finished leather-like sheet was subjected to a flammability test, it was confirmed that the sheet was slowly flammable. Thus, the flame retardant performance of the sheet was insufficient for use as upholstery materials for vehicle seats and interiors.

Further, as a result of observing the interior of the dyeing vessel after the exhaustion treatment, it was confirmed that the interior wall of the vessel was considerably fouled by the flame retardant that had remained unexhausted.

Comparative Example 5

A suede-finished leather-like sheet was prepared in the same manner as in Example 1 except for applying the flame retarder liquid which was not foamed, to the back surface of the leather-like sheet.

When the obtained suede-finished leather-like sheet was subjected to a flammability test, it was confirmed that the sheet was self-extinguishing and had sufficient flame retardant performance for use as upholstery materials for vehicle seats and interiors.

However, raised fiber portions on the front surface of the suede-finished leather-like sheet had somewhat tacky or slimy touch attributed to the flame retarder. Further, the hand was hard and deteriorated as compared with the flame retardant suede-finished leather-like sheet of Example 1, and the sheet was apparently at a low level for use as upholstery materials for vehicle seats and interiors.

When cross-sections of the suede-finished leather-like sheet were observed with a scanning electric microscope to evaluate the coating condition of the flame retarder, it was confirmed that the flame retarder was present in the vicinity of the napped surface.

Further, when the back surface of the suede-finished leather-like sheet was also observed with a scanning electric microscope, it was confirmed that the flame retarder was deposited over the whole back surface in the form of a film without penetrating into the sheet. No particles, aggregates or porous bodies were present. Further, no domains were formed.

INDUSTRIAL APPLICABILITY

The flame retardant suede-finished leather-like sheet of the present invention has a soft hand and an excellent flame retardancy and is therefore suitable, in particular, for use as upholstery materials for vehicle seats and for interiors such as cushion sheets, couches and chairs.

What is claimed is:

1. A flame retardant leather-like sheet comprising an entangled nonwoven fabric of polyester microfine fibers having an average single-fiber fineness of 0.5 dtex or less, and an elastic polymer A impregnated into the nonwoven fabric, wherein a flame retardant is exhausted into the elastic polymer A, and wherein the leather-like sheet further comprises a coating formed by applying a flame retarder liquid, which contains forcibly formed air bubbles, to a back surface of the leather-like sheet so that said flame retarder is present in a region extending from the back surface to an inside of the leather-like sheet but is not present on side of a front surface of the leather-like sheet.

2. The flame retardant leather-like sheet according to claim 1, wherein the flame retardant exhausted into the elastic polymer A and the flame retarder applied to the back surface of the leather-like sheet are each a non-halogen flame retardant.

3. A flame retardant suede-finished leather-like sheet obtained by a method comprising the step of napping the front surface of the flame retardant leather-like sheet as defined in claim 1.

4. A method of producing a flame retardant leather-like sheet, comprising successively subjecting a leather-like sheet, which comprises an entangled nonwoven fabric of polyester microfine fibers having an average single-fiber fineness of 0.5 dtex or less and an elastic polymer A impregnated into the nonwoven fabric, to the following steps (1) and (2):

(1) a step of immersing the leather-like sheet in a bath comprising a flame retardant dispersed or dissolved in hot water at a temperature of 50 to 100° C. to exhaust the flame retardant into the elastic polymer A; and (2) a step of applying a flame retarder liquid, which contains forcibly formed air bubbles, to a back surface of the leather-like sheet.

5. The method of producing a flame retardant leather-like sheet according to claim 4, wherein the flame retarder liquid has a flame retarder content of 5 to 60% by mass.

6. The method of producing a flame retardant leather-like sheet according to claim 4, wherein the flame retarder liquid containing forcibly formed air bubbles has an apparent density of 0.1 to 0.6 g/cm$^3$.

7. A flame retardant leather-like sheet comprising an entangled nonwoven fabric of polyester microfine fibers having an average single-fiber fineness of 0.5 dtex or less, and an elastic polymer A impregnated into the nonwoven fabric, said leather-like sheet being dyed with a disperse dye, wherein a hot water-soluble, phosphorus-based flame retardant is exhausted into at least an inside of the elastic polymer A, wherein a composition comprising an elastic polymer B and a phosphorus-based flame retarder is present in a region extending from a back surface to an inside of the leather-like sheet in the form of particles, aggregates or a mixture of particles and aggregates, in the form of porous bodies or in the form of a mixture of these forms, and wherein neither said phosphorus-based flame retarder nor said elastic polymer B is present on side of a front surface of the leather-like sheet.

8. The flame retardant leather-like sheet according to claim 7, wherein the phosphorus-based flame retarder constituting said composition is at least one member selected from the group consisting of guanidine phosphate flame retarders, phosphoric carbamate flame retarders, phosphoric acid ester flame retarders, aromatic condensed phosphoric acid ester flame retarders, phosphoric acid ester amide flame retarders, ammonium polyphosphate flame retarders and flame retarders obtained by coating these flame retarders with a silicone resin.

9. The flame retardant leather-like sheet according to claim 7, wherein the hot water-soluble, phosphorus-based flame retardant is at least one member selected from the group consisting of phosphoric acid ester flame retardants, aromatic condensed phosphoric acid ester flame retardants and phosphoric acid amide flame retardants.

10. The flame retardant leather-like sheet according to claim 7, wherein said composition is present in the form of particles having a particle diameter of 1 to 20 μm, aggregates of said particles having a particle diameter of 10 to 500 μm or a mixture of said particles and said aggregates, in the form of porous bodies having a multiplicity of fine pores having a diameter of 1 to 100 μm or in the form of a mixture of these forms.

11. The flame retardant leather-like sheet according to claim 7, wherein said composition forms a discontinuous flame retarder layer comprising domains having a diameter of 700 to 1,500 μm.

12. A method of producing a flame retardant leather-like sheet, comprising successively subjecting a leather-like sheet, which comprises an entangled nonwoven fabric of polyester microfine fibers having an average single-fiber fineness of 0.5 dtex or less and an elastic polymer A impregnated into the nonwoven fabric, to the following steps (a) to (c):

(a) a step of dyeing said leather-like sheet in a bath of disperse dye-containing hot water at a temperature of 100 to 150° C., and reducing and washing the dyed leather-like sheet;

(b) a step of treating the dyed leather-like sheet in a bath of a hot water containing a hot water-soluble, phosphorus-type flame retardant at a temperature of 50 to 100° C. to exhaust the flame retardant into the elastic polymer A; and (c) a step of forcibly applying to a back surface of the leather-like sheet, a foam processing liquid which has been obtained by foaming a solution comprising a phosphorus-based flame retarder, an elastic polymer B and a surfactant so that the obtained foam processing liquid contains bubbles having a diameter of 5 to 300 μm at least as a majority of whole bubbles therein.

13. The method of producing a flame retardant leather-like sheet according to claim 12, wherein the elastic polymer A is an aqueous polyurethane.

14. The method of producing a flame retardant leather-like sheet according to claim 12, wherein the elastic polymer B is an aqueous polyurethane.

15. The method of producing a flame retardant leather-like sheet according to claim 12, wherein in step (c), the foam processing liquid is applied by gravure coating or by screen coating.

16. The method of producing a flame retardant leather-like sheet according to claim 12, wherein the step (c) is followed by a step of mechanically flexing the obtained leather-like sheet.

* * * * *